US006830637B2

(12) United States Patent
Morgan et al.

(10) Patent No.: US 6,830,637 B2
(45) Date of Patent: Dec. 14, 2004

(54) LARGE DIAMETER TUNGSTEN-LANTHANA ROD

(75) Inventors: Ricky D. Morgan, Milan, PA (US); Thomas J. Dixon, Towanda, PA (US); Harry D. Martin, III, Troy, PA (US)

(73) Assignee: Osram Sylvania Inc., Danvers, MA (US)

( * ) Notice: Subject to any disclaimer, the term of this patent is extended or adjusted under 35 U.S.C. 154(b) by 59 days.

(21) Appl. No.: 10/160,751

(22) Filed: May 31, 2002

(65) Prior Publication Data

US 2003/0221755 A1 Dec. 4, 2003

(51) Int. Cl.[7] ..... C22C 27/04

(52) U.S. Cl. ..... 148/423; 75/230; 75/235; 75/248; 420/430; 420/431; 420/432; 420/433

(58) Field of Search ..... 75/230, 235, 248; 148/423; 420/430, 431, 432, 433

(56) References Cited

U.S. PATENT DOCUMENTS

| | | | | |
|---|---|---|---|---|
| 3,086,103 A | | 4/1963 | Hackman et al. | 219/74 |
| 3,159,908 A | | 12/1964 | Anders | 29/182.5 |
| 4,923,673 A | | 5/1990 | Litty | 419/20 |
| 4,950,327 A | * | 8/1990 | Eck et al. | 75/232 |
| 5,051,139 A | * | 9/1991 | Eck | 148/514 |
| 5,590,386 A | | 12/1996 | Patrician et al. | 419/20 |
| 5,742,891 A | | 4/1998 | Patrician et al. | 419/4 |

OTHER PUBLICATIONS

Metals Handbook, Ninth Edition, vol. 14, pp. 330 to 333, 1988.*

* cited by examiner

*Primary Examiner*—John P Sheehan
(74) *Attorney, Agent, or Firm*—Robert F. Clark

(57) ABSTRACT

A large-diameter tungsten-lanthana rod having an elongated grain structure substantially parallel to the longitudinal axis of the rod is described. The large diameter rod is produced by rolling at a temperature greater than 1400° C. and less than 1700° C. to achieve at least about a 40% reduction in cross-sectional area. The high strength of the longitudinally elongated grain structure is desirable for applications such as rocket nozzles.

7 Claims, 2 Drawing Sheets

LARGE DIAMETER TUNGSTEN-LANTHANA ROD

TECHNICAL FIELD

This invention is related to tungsten rod and methods of forming tungsten rod. More particularly, it is related to large-diameter tungsten-lanthana rod with an elongated grain structure.

BACKGROUND OF THE INVENTION

Tungsten-lanthana alloys are well-known. A description of these alloys, their methods of making, and uses can be found in U.S. Pat. Nos. 5,590,386, 5,742,891, 4,923,673, 3,159,908 and 3,086,103.

In addition to the uses referenced above, tungsten-lanthana alloys are used to manufacture rocket nozzles. Rocket nozzles require high strength along the nozzle's longitudinal axis because of the high temperatures and internal combustive forces generated during its operation. In order to provide this high strength, the tungsten-lanthana rod from which the nozzle is machined should have a microstructure in which the tungsten grains are elongated in a direction substantially parallel to the longitudinal axis of the rod. Current methods of forging and extrusion for forming large-diameter tungsten rods (>0.625 in. dia.) achieve acceptable mechanical properties but have been ineffective at producing a longitudinal grain elongation.

SUMMARY OF THE INVENTION

It is an object of the invention to obviate the disadvantages of the prior art.

It is another object of the invention to provide a large diameter tungsten-lanthana rod having a grain structure which is elongated in a direction substantially parallel to the longitudinal axis of the rod.

It is still another object of the invention to provide a large-diameter tungsten-lanthana rod having mechanical properties desirable for rocket nozzle applications.

These and other objects and advantages of the invention have been achieved by rolling large-diameter tungsten-lanthana rod at a temperature greater than 1400° C. and less than 1700° C. to achieve a reduction in the cross-sectional area of at least about 40%. These rolling parameters yield a large-diameter rod having an elongated grain structure which is substantially parallel to the longitudinal axis of the rod. The as-worked rod has mechanical properties desirable for rocket nozzle applications.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

A rolling process has been developed to produce large-diameter tungsten-lanthana rod with grain elongation substantially parallel to the longitudinal axis of the rod. As used herein, large diameter means that the rod has a diameter greater than 0.625 inches as worked. Acceptable mechanical properties were achieved with at least about a 40% reduction in cross-sectional area (RIA). Preferably, the diameter of the worked rod ranges from greater than 0.625 inches to 2.250 inches and the lanthana contents range from 0.3 wt. % to 2.5 wt. %.

The parallel-elongated structure was achieved by rolling bars of tungsten-lanthana at temperatures greater than 1400° C. In particular, rolling temperatures must be greater than 1400° C. and less than 1700° C. Rod reheating can occur at any point up to a maximum of four rolling passes. Starting bar diameters of greater than 1.5 inches require an in-process stress relief at a point between 25 and 45% reduction in area.

The following non-limiting examples are presented.

EXAMPLE 1

A pressed and sintered bar of tungsten containing 1.3 wt. % lanthana (LT8103-008) and measuring 2.374 inches in diameter by 23.5 inches in length was rolled at 1500° C. on a two-high rod rolling mill to 1.850 inches in diameter by 38 inches in length (a reduction-in-area of 39.27%) and stress relieved at 1400° C. for ½ hour. The rolling schedule is given in Table 1. The material was then tested for tensile properties, density, and hardness. The test results are provided in Table 4. Microstructures showed grain elongation parallel to the longitudinal axis of the rod.

TABLE 1

| Pass No. | Groove Dia. (in.) | 1500° C. Soak Time (min.) | Nominal. Diameter Before (in.) | Nominal Diameter After (in.) | RIA (%) | cumulative RIA (%) |
|---|---|---|---|---|---|---|
| 1 | 2.393 | 15 | — | — | — | — |
| 2 | 2.393 | 5 | — | — | — | — |
| 3 | 2.146 | 5 | — | 2.325 | — | 4.1 |
| 4 | 2.146 | 5 | 2.325 | — | — | — |
| 5 | 2.020 | 5 | — | — | — | — |
| 6 | 2.020 | 5 | — | 2.085 | — | 22.9 |
| 7 | 1.875 | 15 | 2.085 | 1.985 | 9.4 | 30.1 |
| 8 | 1.875 | 5 | 1.985 | 1.850 | 13.1 | 39.3 |

EXAMPLE 2

Figure 1:
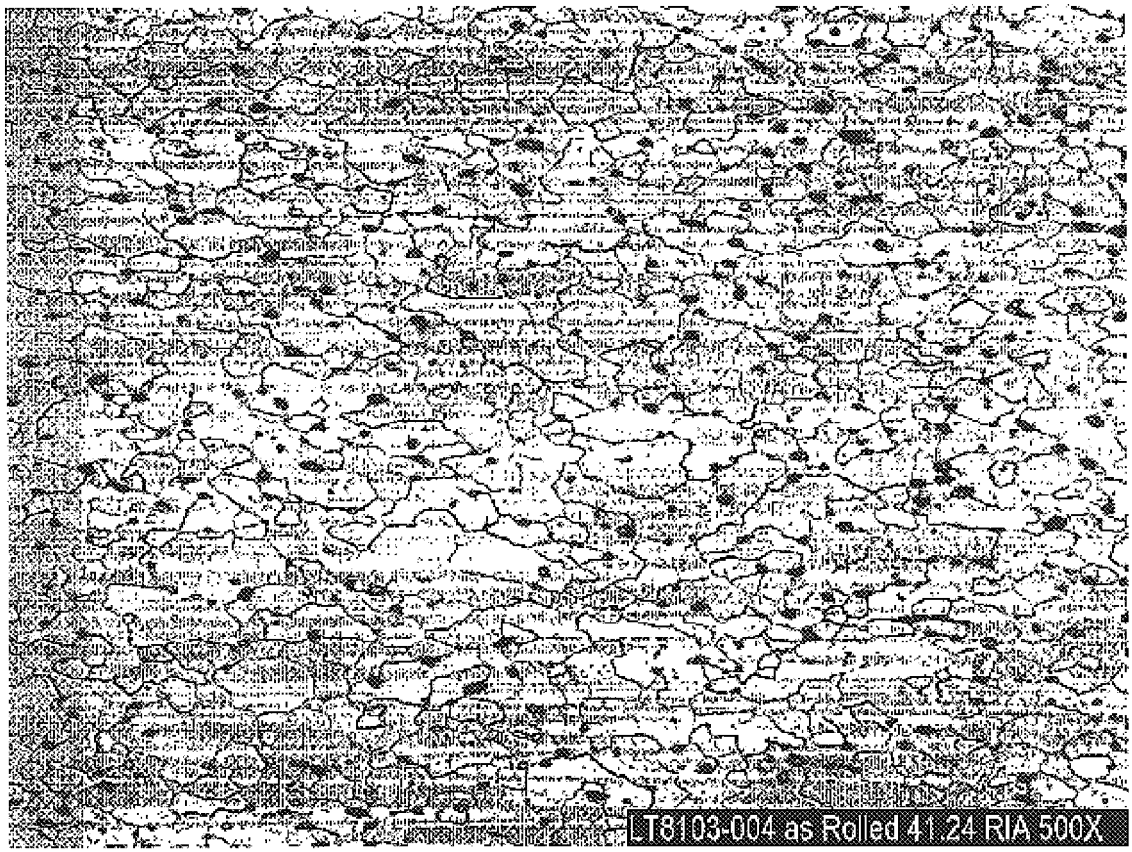
FIG. 1 is a micrograph of the longitudinally elongated grain structure of a rolled tungsten-lanthana rod subjected to a reduction in cross-sectional area of about 40%.
Figure 2:
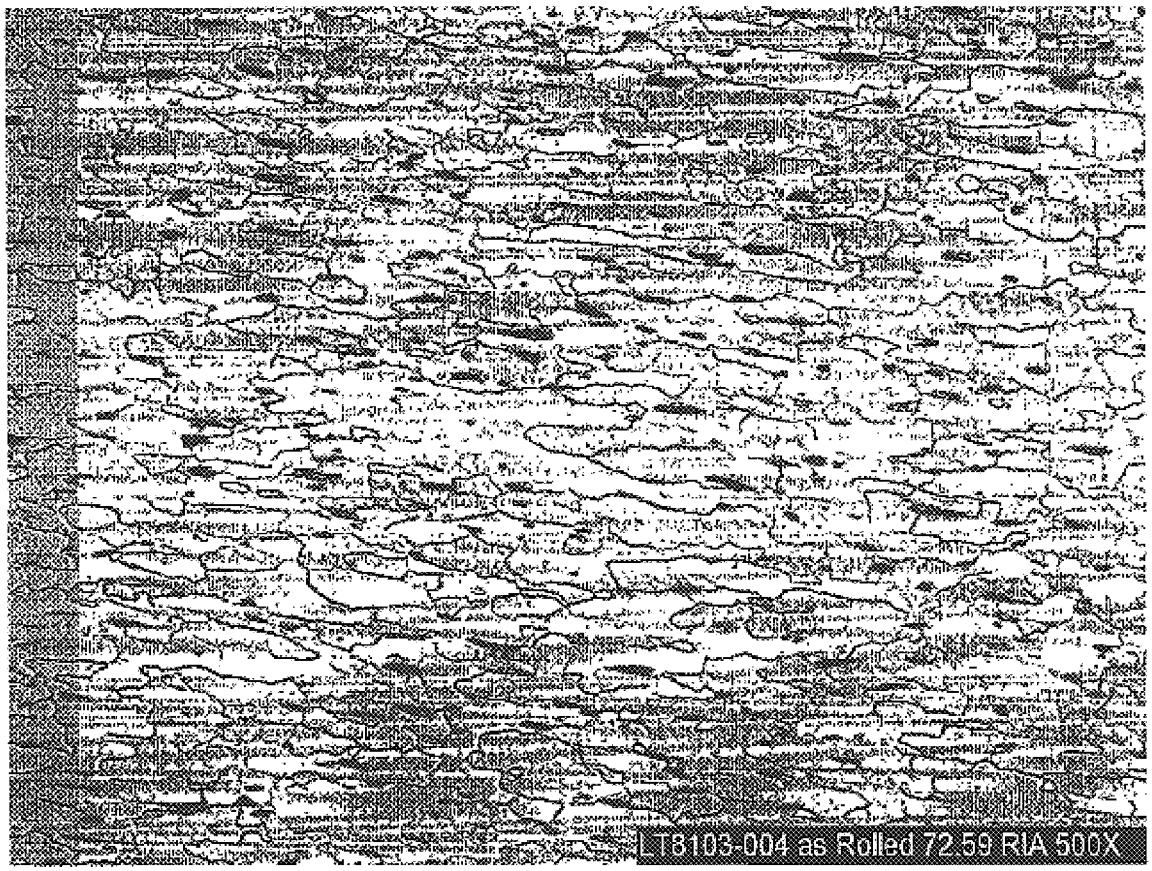
FIG. 2 is a micrograph of the longitudinally elongated grain structure of a rolled tungsten-lanthana rod subjected to a reduction in cross-sectional area of about 70%.

A pressed and sintered bar of tungsten containing 1.3 wt. % lanthana (LT8103-004) and measuring 1.400 inches in diameter by 33 inches in length was reduced by a two-high rod rolling method to 0.733 inches in diameter by 50 inches in length at 1500° C. The rod was then finish swaged to 0.682 in diameter by 56 inches in length at 1300° C.; a total reduction-in-area of 76%. The rolling schedule is provided in Table 2. The measured mechanical properties are given in Table 4. FIGS. 1 and 2 show the microstructures of the rolled rods after about 40% RIA and about 70% RIA, respectively. Greater elongation is observed at the higher RIA. Grain elongation was parallel to the longitudinal axis of the rod. Grains are elongated from left to right in the micrographs. The black specks in the micrographs are the lanthana particles.

TABLE 2

| Pass No. | Groove Dia. (in.) | 1500° C. Soak Time (min.) | Nominal. Diameter Before (in.) | Nominal Diameter After (in.) | RIA (%) | Cumulative RIA (%) |
|---|---|---|---|---|---|---|
| 1 | 1.320 | 15 | 1.400 | — | — | — |
| 2 | 1.320 | 5 | — | — | — | — |
| 3 | 1.219 | 5 | — | — | — | 4.1 |
| 4 | 1.219 | 5 | — | 1.290 | — | 15.1 |
| 5 | 1.125 | 5 | 1.290 | 1.195 | 14.2 | 27.1 |
| 6 | 1.125 | 5 | 1.195 | 1.178 | 2.8 | 29.2 |
| 7 | 1.040 | 5 | 1.178 | 1.091 | 14.2 | 39.3 |
| 8 | 1.040 | 5 | 1.091 | 1.084 | 1.3 | 40.0 |
| 9 | 0.969 | 5 | 1.084 | 1.015 | 12.3 | 47.4 |
| 10 | 0.969 | 5 | 1.015 | 1.002 | 2.5 | 48.8 |
| 11 | 0.906 | 5 | 1.002 | 0.940 | 12.0 | 54.9 |
| 12 | 0.906 | 5 | 0.940 | 0.930 | 2.1 | 55.9 |
| 13 | 0.850 | 5 | 0.930 | 0.855 | 15.5 | 62.7 |
| 14 | 0.850 | 5 | 0.855 | 0.855 | 0.0 | 62.7 |
| 15 | 0.797 | 5 | 0.855 | 0.795 | 13.5 | 67.8 |
| 16 | 0.797 | 15 | 0.795 | 0.805 | 0.0 | 67.8 |
| 17 | 0.750 | 5 | 0.805 | — | — | — |
| 18 | 0.750 | 5 | — | 0.733 | — | 72.6 |

EXAMPLE 3

Another bar of tungsten-1.3 wt. % lanthana (LT8103-009) measuring 2.41 inches in diameter was reduced by a two-high rod rolling method to a 2.050 inch diameter at 1400° C., a 27.6% reduction in area. At this point, the bar was rolled on a different set of rolls at 1400° C. to 2.025 inches in diameter for a total reduction in area of 29.4%. At this point, the rod split prematurely due to the 1400° C. rolling temperature. After stress relieving the rod at 1500° C. for 30 minutes, the rod was rolled successfully to a 1.265 inch diameter at 1500° C. for a total reduction in area of 72.4%. The rod was then stress relieved at 1400° C. for 30 minutes. The actual rolling schedule is provided in Table 3. Density, hardness and tensile properties are given in Table 4. As expected, grain elongation was parallel to the longitudinal axis of the rod.

TABLE 3

| Pass No. | Groove Dia. (in.) | 1500° C. Soak Time (min.) | Nominal. Diameter Before (in.) | Nominal Diameter After (in.) | RIA (%) | cumulative RIA (%) |
|---|---|---|---|---|---|---|
| 1 | 2.393 | 15 (1400° C.) | — | — | — | — |
| 2 | 2.393 | 5 (1400° C.) | — | — | — | — |
| 3 | 2.146 | 5 (1400° C.) | — | 2.325 | — | 6.9 |
| 4 | 2.146 | 5 (1400° C.) | 2.325 | — | — | — |
| 5 | 2.020 | 5 (1400° C.) | — | — | — | — |
| 6 | 2.020 | 5 (1400° C.) | — | 2.050 | — | 27.6 |
| 7 | 1.875 | 15 (1400° C.) | 2.050 | — | — | — |
| 8 | 1.875 | 5 (1400° C.) | — | 2.025 | 2.4 | 29.4 |
| 9 | 1.718 | 5 (1400° C.) | 2.025 | 1.850 | 16.5 | 41.1 |
| 10 | 1.718 | 15 | 1.850 | 1.733 | 2.5 | 48.3 |
| 11 | 1.718 | 5 | — | — | — | — |
| 12 | 1.578 | 5 | — | — | — | — |
| 13 | 1.578 | 5 | — | 1.580 | — | 57.0 |
| 14 | 1.445 | 5 | 1.580 | — | — | — |
| 15 | 1.445 | 5 | — | 1.422–1.425 | — | 65.1 |
| 16 | 1.320 | 5 | 1.423 | — | — | — |
| 17 | 1.320 | 5 | — | 1.310–1.325 | — | 70.1 |
| 18 | 2.002 | 5 | 1.317 | 1.281 | 5.4 | 71.7 |
| 19 | 2.020 | 5 | 1.281 | 1.265–1.266 | 2.4 | 72.4 |

TABLE 4

| Sample | Sample Direction (longitudinal) | Density (g/cc) | Hardness Rockwell C | UTS (ksi) | YS (ksi) | Elongation % |
|---|---|---|---|---|---|---|
| LT8103-004 | | | | | | |
| As rolled | Edge | 18.76 | 42.7 | — | — | — |
| | Center | 18.72 | 43 | 85.4 | 79.4 | 26 |
| Stress relieved (1500° C., 1/2 hour) | Edge | — | 42.8 | — | — | — |
| | Center | — | 42.9 | 80, 74† | 71, 66† | 27, 27† |
| Stress relieved (1600° C., 1/2 hour) | Edge | — | 42.6 | — | — | — |
| | Center | — | 42.5 | 77, 79† | 69, 72† | 25, 28† |
| LT8103-008 | | | | | | |
| Stress relieved (1400° C., 1/2 hour) | Edge | 18.76 | 40 | 71, 73† | 67, 61† | 32, 35† |
| | Center | 18.6 | 39.7 | 73, 74† | 61, 62† | 28, 30† |

TABLE 4-continued

| Sample | Sample Direction (longitudinal) | Density (g/cc) | Hardness Rockwell C | UTS (ksi) | YS (ksi) | Elongation % |
|---|---|---|---|---|---|---|
| LT8103-009 | | | | | | |
| Stress relieved (1400° C., 1/2 hour) | Edge<br>Center | 18.72<br>18.64 | 41<br>41.3 | 77, 78†<br>81 | 62, 64†<br>59 | 33, 34†<br>56 |

†values for two samples

The mechanical properties compare favorably with the values measured for forged materials. In particular, the ultimate tensile strength (UTS) for forged materials ranges from 65 to 89 ksi; the yield strength (YS) from 53 to 82 ksi; elongation from 12 to 32%; and hardness from 41 to 42 Rockwell C. The results in Table 4 demonstrate that the large-diameter tungsten-lanthana rod of this invention has a UTS of from about 70 to about 85 ksi, a YS of from about 60 to about 80 ksi and a hardness of from about 40 to about 43 Rockwell C. Thus, the large-diameter rod of this invention possesses both the grain structure and mechanical properties desired for rocket nozzle applications.

While there has been shown and described what are at the present considered the preferred embodiments of the invention, it will be obvious to those skilled in the art that various changes and modifications may be made therein without departing from the scope of the invention as defined by the appended claims.

We claim:

1. A large-diameter tungsten-lanthana rod having an elongated grain structure substantially parallel to the longitudinal axis of the rod wherein the diameter of the rod is greater than 0.625 inches.

2. The tungsten-lanthana rod of claim 1 wherein the lanthana content of the rod is from 0.3 weight percent to 2.5 weight percent.

3. The tungsten-lanthana rod of claim 1 wherein the rod was subjected to at least about a 40% reduction-in-area to achieve the diameter.

4. The tungsten-lanthana rod of claim 1 wherein the rod has a UTS of from about 70 to about 85 ksi, a YS of from about 60 to about 80 ksi and a hardness of from about 40 to about 43 Rockwell C.

5. The tungsten-lanthana rod of claim 1 wherein the rod was subjected to about a 70% reduction-in-area to achieve the diameter.

6. The tungsten-lanthana rod of claim 1 wherein the diameter of the rod ranges from greater than 0.625 inches to 2.250 inches.

7. The tungsten-lanthana rod of claim 4 wherein the lanthana content of the rod is from 0.3 weight percent to 2.5 weight percent.

* * * * *